US005622289A

United States Patent [19]

Dedoes

[11] Patent Number: 5,622,289

[45] Date of Patent: Apr. 22, 1997

[54] PAINT CAN COVER ASSEMBLY

[75] Inventor: John T. Dedoes, Brighton, Mich.

[73] Assignee: Dedoes Industries, Inc., Walled Lake, Mich.

[21] Appl. No.: 673,955

[22] Filed: Jul. 1, 1996

[51] Int. Cl.[6] ..... A47G 19/00

[52] U.S. Cl. ..... 222/472; 222/570; 366/247; 366/343; 366/605

[58] Field of Search ..... 222/472, 568, 222/570; 366/343, 247, 325, 605

[56] References Cited

U.S. PATENT DOCUMENTS

| | | | |
|---|---|---|---|
| 423,867 | 3/1890 | Hadley | 222/472 |
| 4,926,390 | 5/1990 | Murzsa | 366/605 X |
| 5,094,543 | 3/1992 | Mursa | 366/247 |
| 5,437,400 | 8/1995 | Loeffler | 222/570 |
| 5,462,201 | 10/1995 | Wilkins | 222/472 X |

*Primary Examiner*—Gregory L. Huson
*Attorney, Agent, or Firm*—Gifford, Krass, Groh, Sprinkle, Patmore, Anderson & Citkowski, P.C.

[57] ABSTRACT

A cover assembly as provided for a paint can having an open top and a tubular cylindrical sidewall. The cover assembly includes a lid dimensioned to overlie the open top of a paint can and having a spout for dispensing paint from the can. A closure assembly is also provided for selectably opening and closing the spout, and a paint stirrer is rotatably secured to the lid. An annular skirt extends downwardly from the lid and includes a portion which overlies the sidewall when the lid is positioned on top of the can. The skirt is compressed against the sidewall by a locking mechanism to thereby attach the lid to the can. A removable closure cover is provided for both the portion of the closure overlying the spout as well as a spout cover which overlies both the spout and the adjacent portion of the lid.

13 Claims, 2 Drawing Sheets

FIG-3
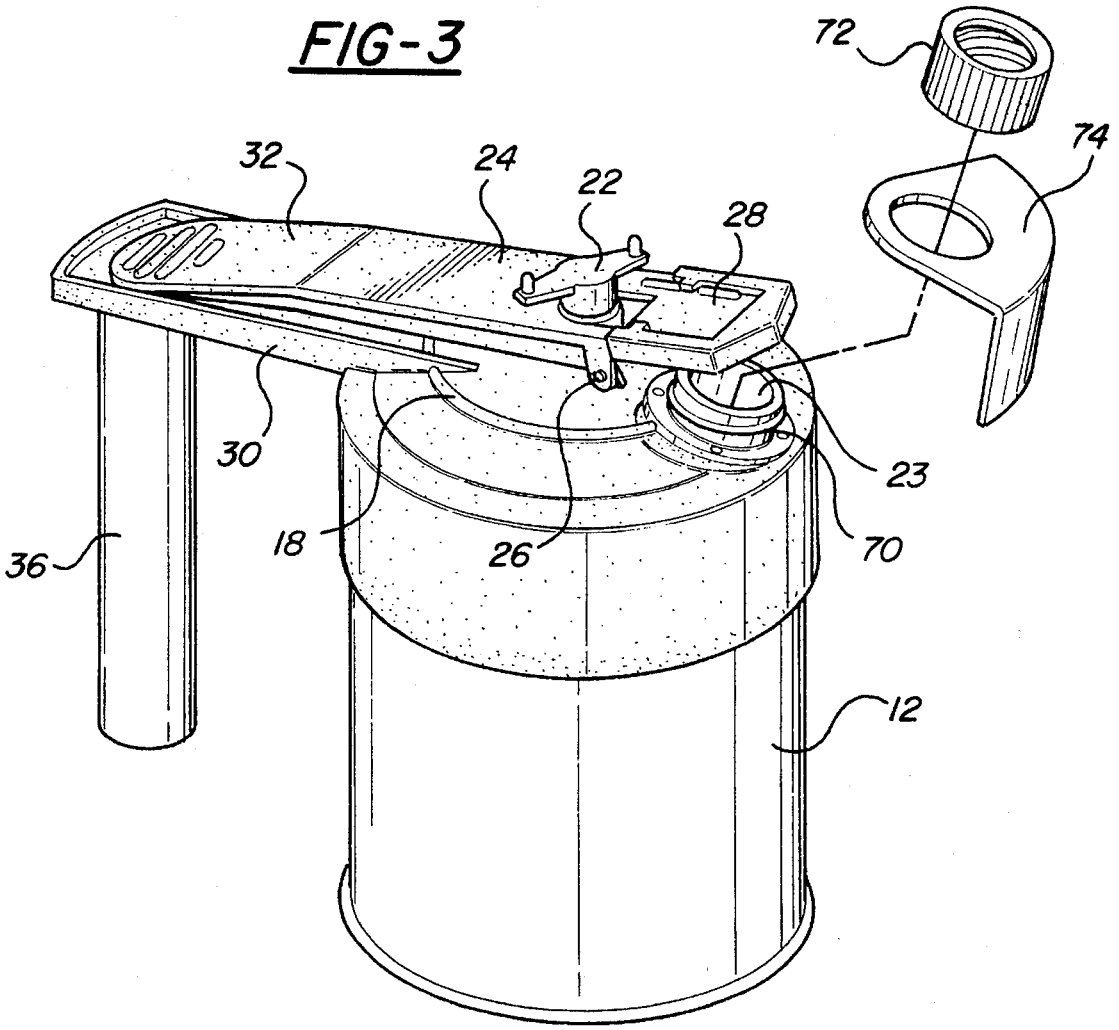
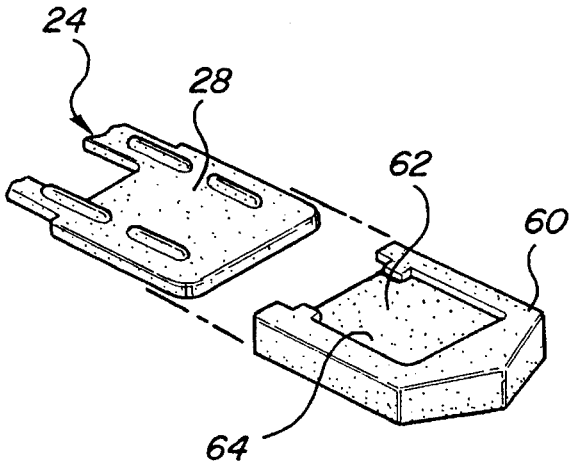
FIG-4
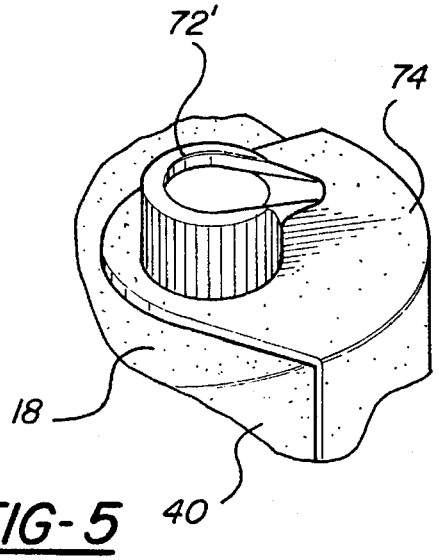
FIG-5

PAINT CAN COVER ASSEMBLY

BACKGROUND OF THE INVENTION

I. Field of the Invention

The present invention relates to a cover assembly for a paint can.

II. Description of the Prior Art

There are a number of previously known cover assemblies which are designed to overlie the open top of a paint can. Such cover assemblies include a spout and a cooperating closure which selectably opens and closes the spout. When the spout is opened, paint can be poured from the can.

Many of these previously known cover assemblies are designed for use with automatic stirring equipment. As such, they include a stirring assembly rotatably mounted to the cover assembly and having a stirrer positioned within the can. A driven member extending upwardly from the cover assembly cooperates with a drive member in a rack of the automated paint stirring equipment in order to continuously stir the paint. Such automatic paint stirring equipment is typically used in automotive body repair shops and the like.

In order to secure the cover assembly to the top of the paint can, typically two or more locking feet are attached to the paint can lid. These locking feet are spring loaded and rotatable between a locked and an unlocked position. In their locked position, the locking feet extend under the paint can chime such that a portion of the paint can chime is compressibly engaged between the lid and the locking feet.

These previously known cover assemblies, however, suffer from a number of disadvantages. One disadvantage is that the locking feet used to secure the lid to the top of the paint can are relatively expensive. Furthermore, after prolonged use, these locking feet can break or, alternatively, damage the paint can chime.

A still further disadvantage of these previously known paint can cover assemblies is that, after extended use, unwanted paint covers not only the closure around the spout, but also the paint can lid adjacent the spout area. When such paint accumulation becomes unacceptable, it has been previously necessary to replace the entire paint can cover assembly.

SUMMARY OF THE PRESENT INVENTION

The present invention provides a cover assembly for a paint can which overcomes all of the above-mentioned disadvantages of the previously known devices.

In brief, the cover assembly of the present invention comprises a lid dimensioned to overlie the open top of a paint can. The lid includes a spout opening for dispensing paint from the can.

The cover assembly of the present invention is designed for use in automatic paint stirring equipment. As such, the cover assembly includes a paint stirring means rotatably secured to the lid and having a stirrer positioned within the interior of the paint can when the lid is positioned over the top of the paint can. A closure is also pivotally mounted to the lid and movable between an open and a closed position. In its closed position, one end of the closure overlies and covers the spout opening. Conversely, in its open position, the end of the closure is spaced from the spout opening such that paint can be dispensed from the can.

In order to secure the lid to the paint can, the present invention provides an annular skirt which depends downwardly from the lid such that the skirt overlies a portion of the paint can sidewall adjacent its top. A toothed ratchet mechanism on the annular skirt is then used to compress the annular skirt around the can sidewall thereby securing the cover assembly to the paint can.

The present invention also provides a closure cover which is detachably secured to the end of the closure adapted to cover the spout opening. Thus, paint accumulation occurs on the closure cover, rather than the closure, after prolonged use. When such paint accumulation becomes excessive, the closure cover is simply removed and replaced with a new cover.

Similarly, a spout cover is detachably secured to the spout opening such that paint accumulation after prolonged use occurs on the spout cover, rather than the spout itself. This spout cover, furthermore, preferably includes a flange which overlies a portion of the paint can lid adjacent the spout opening. Consequently, any dripping that occurs from the spout during a pouring operation will accumulate on the spout cover rather than the lid. When such accumulation becomes excessive, the spout cover is simply removed and replaced with a new spout cover.

The removable spout covers can also be utilized to change the shape of the dispensing spout. In some instances, a circular spout opening is desired while in other instances, different shapes, such as a V-shaped spout, is desired. Since the shape of a spout can be formed directly in the spout cover, different spout shapes can be achieved by using the same basic cover assembly.

Preferably, the cover assembly of the present invention is constructed of plastic or other nonmetallic material. As such, the cover assembly can be used with water based paints without fear of oxidation of the cover.

BRIEF DESCRIPTION OF THE DRAWING

A better understanding of the present invention will be had upon reference to the following detailed description when read in conjunction with the accompanying drawing, wherein like reference characters refer to like parts throughout the several view, and in which:

FIG. 3 is an exploded elevational view illustrating the preferred embodiment of the present invention;

FIG. 4 is a fragmentary exploded view illustrating one feature of the present invention; and FIG. 5 is a fragmentary elevational view illustrating a further feature of the present invention.

DETAILED DESCRIPTION OF A PREFERRED EMBODIMENT OF THE PRESENT INVENTION

Figure 1:
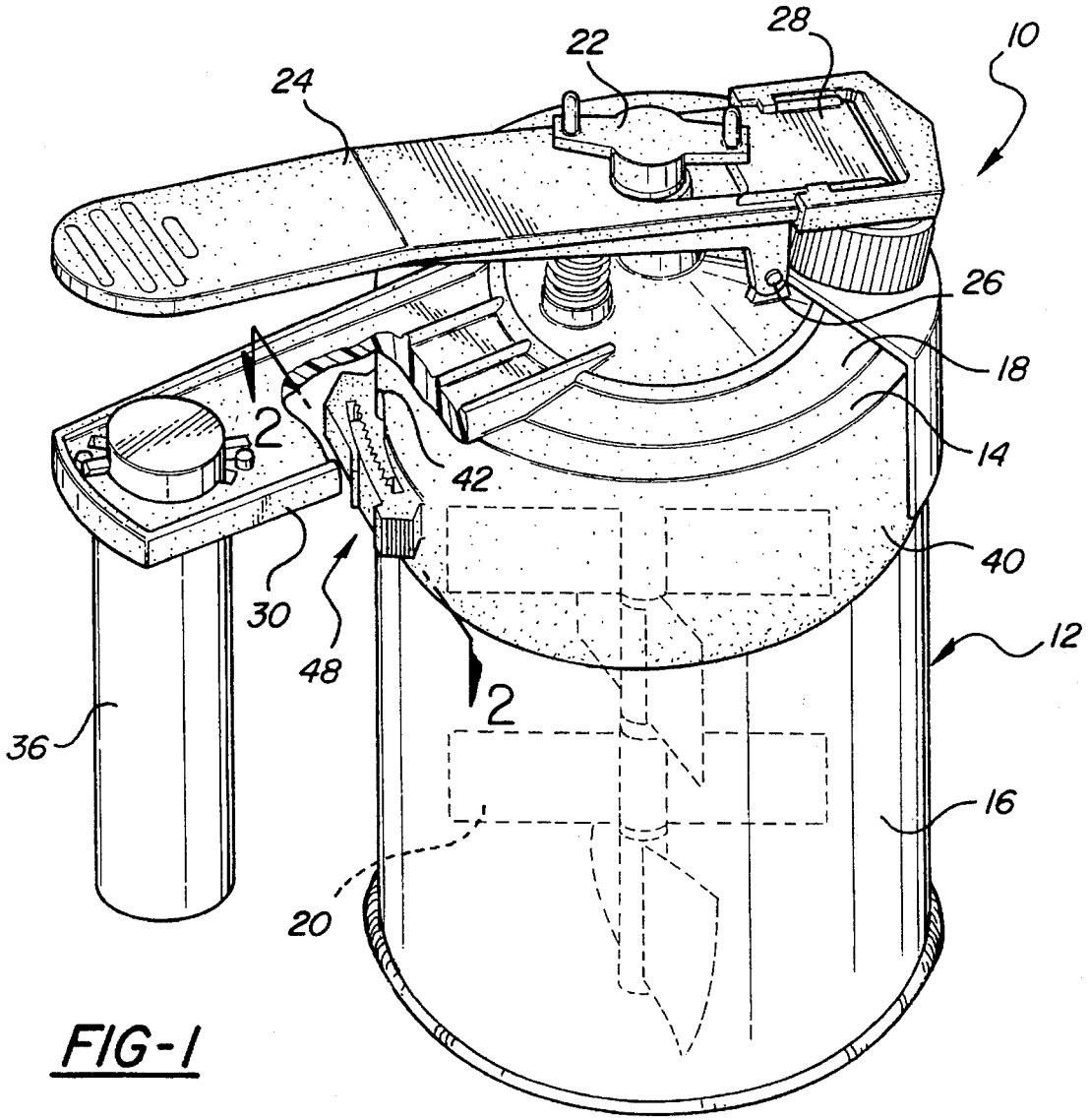
FIG. 1 is an elevational view illustrating a preferred embodiment of the present invention.

With reference first to FIG. 1, a preferred embodiment of the cover assembly 10 of the present invention is there shown for use with a standard paint can 12. The paint can 12, which may be of any conventional size, includes an open top 14 and a tubular cylindrical sidewall 16 which defines the interior of the paint can.

The cover assembly 10 includes a generally circular lid 18 which is dimensioned to overlie and cover the open top 14 of the paint can 12. A paint stirrer 20 is rotatably mounted to the lid 18 and is positioned within the interior of the paint can 12 when the cover assembly 10 is secured across the open top 14 of the paint can 12. A driven member 22 is secured to the stirrer 20 and is adapted to be rotatably driven by automatic paint stirring equipment to thus stir the paint within the can.

Referring now to FIGS. 1 and 3, the lid 18 includes a spout opening 23 (FIG. 3) for dispensing paint from the interior of the can. A closure 24 is then pivotally mounted by pivot pins 26 to the lid 18 so that the closure 24 is pivotal between the closed position, illustrated in FIG. 1, and an open position illustrated in FIG. 3. In its closed position (FIG. 1) an end 28 of the closure 24 overlies and covers the spout opening 23. Conversely, in its open position (FIG. 3) the end 28 of the closure 24 is spaced from the spout opening 23 to thus allow paint to be dispensed from the paint can 12.

In the preferred embodiment of the invention, an elongated extension 30 extends outwardly from the lid 18. This extension 30 generally underlies the end 32 of the closure 24 opposite from its spout end 28. A handle 36 is then secured to and depends downwardly from the outer or free end of the extension 30. The handle 36 thus provides a convenient means for manipulating the cover assembly 10 with its attached paint can 12 and to facilitate actuation of the closure 24.

Figure 2:
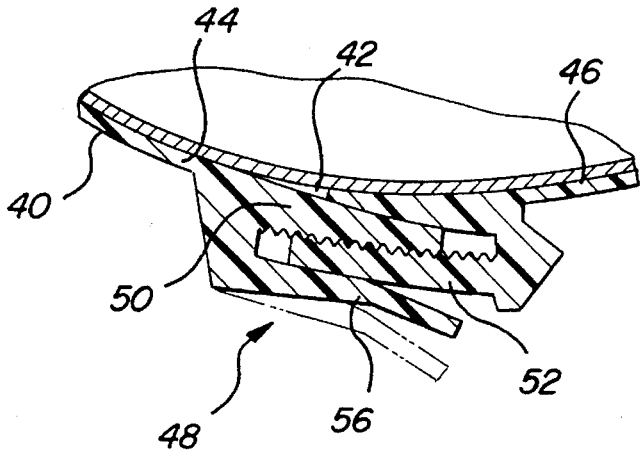
FIG. 2 is a fragmentary sectional view taken substantially along line 2—2 in FIG. 1 and enlarged for clarity.

With reference now to FIGS. 1 and 2, in order to secure the cover assembly 10 the paint can 12, an annular skirt 40 extends downwardly from an outer periphery of the lid 18 such that the skirt 40 overlies a portion of the annular sidewall 16 adjacent the open top 14 of the paint can 12. A longitudinally extending slot 42 is then provided through the skirt 40 thus forming two ends 44 and 46 (FIG. 2) in the skirt 40.

Still referring to FIGS. 1 and 2, in order to secure the skirt 40 to the paint can 12, and thus secure the cover assembly 10 to the paint can 12, a locking mechanism 48 is provided between the ends 44 and 46 of the skirt 40 in order to adjustably compressibly secure the skirt 40 around the sidewall 16 of the paint can 12. In the preferred embodiment of the invention, the locking means comprises a first toothed member 50 attached to one end 44 of the skirt 40 which meshes with a like toothed member 52 attached to the other end 46 of the skirt 40. The diameter of the skirt 40, and thus the compression of the skirt 40 around the paint can sidewall 16, is adjusted by adjusting the longitudinal position of the toothed members 50 and 52 relative to each other.

With reference now particularly to FIG. 2, in order to attach the cover assembly 10 to the paint can 12, the toothed members 50 and 52 are compressed towards each other thus effectively reducing the diameter of the skirt 40 until the skirt 40 is compressibly attached to the paint can 12. A resilient latch 56 maintains the locking engagement of the toothed members 50 and 52 with respect to each other. However, when detachment of the cover assembly 10 from the paint can 12 is desired, the latch 56 is moved outwardly as shown in phantom line thus allowing the toothed members 50 and 52 to be separated from each other and the cover assembly 10 detached from the can 12.

Preferably, the lid 18, skiff 40 and locking means 48 are all of a one piece plastic or elastomeric construction. Other materials, however, may alternatively be used without deviation from the spirit or scope of the invention.

With reference now particularly to FIG. 4, a further feature of the present invention is there shown in which a closure cover 60 is detachably secured to the end 28 of the closure 24. The closure cover 60 includes a bottom wall 62 which actually contacts and covers the spout opening 23 (FIG. 3) so that, after prolonged use, paint accumulates on the closure cover 60 rather than the end 28 of the closure 24.

Although any conventional means can be used to detachably secure the closure cover 60 to the closure 24, preferably the closure cover 60 includes a channel 64 dimensioned to slidably receive the end 28 of the closure 24 and frictionally secure the closure cover 60 to the closure 24.

With reference now particularly to FIG. 3, in the preferred embodiment of the invention, the spout opening 23 includes an outer threaded portion 70. An internally threaded spout cover 72 is then detachably threadably secured to the thread 70 around the spout opening so that the spout cover 72 covers the spout opening 23. Additionally, a shield 74 is sandwiched in between the spout cover 72 and the lid 18 so that the shield 74 overlies and covers a portion of the lid 18 and skirt 40 adjacent the spout opening 23 (see FIG. 5).

In operation, the spout cover 72 together with the shield 74 protect the paint can lid 18 and closure 24 from paint drips which occur during use of the cover assembly 10. Rather, paint accumulation occurs on the shield 74, spout cover 72 and the closure cover 60 (FIG. 4). When such paint accumulation becomes unacceptable, the closure cover 60 and/or spout cover 72 and its shield 74 can be removed and replaced with a new closure cover or spout cover and shield.

With reference now to FIG. 5, a modification to the spout cover 72' is there shown in which the dispensing spout formed by the spout cover 72 is substantially V-shaped rather than circular as shown in 72. Thus, by utilizing spout covers 72 having different shapes of the dispensing opening, the dispensing opening can be rapidly altered while using the same basic lid with its associated components.

From the foregoing, it can be seen that the present invention provides a cover assembly for a paint can which is not only inexpensive to manufacture, but also effective in use.

Having described my invention, however, many modifications thereby will become apparent to those skilled in the art to which it pertains without deviation from the spirit of the invention as defined by the scope of the appended claims.

I claim:

1. A cover assembly for a paint can having a tubular cylindrical sidewall and an open top comprising:

a lid dimensioned to overlie the open top of the paint can, said lid having a spout, paint stirring means rotatably secured to said lid, an annular skirt which depends downwardly from said lid and overlies a portion of the can sidewall when said lid is positioned on the top of the can, and means for compressing said skirt against the can sidewall to thereby attach said lid to the can.

2. The invention as defined in claim 1 wherein said lid and said skirt are of a one piece construction.

3. The invention as defined in claim 2 wherein said lid and said skirt are made of a non-metallic material.

4. The invention as defined in claim 2 wherein said lid and said skirt are made of plastic.

5. The invention as defined in claim 1 wherein said skirt includes two facing ends and wherein said compressing means comprises means for pulling said ends toward each other.

6. The invention as defined in claim 5 wherein said pulling means comprises a first toothed member on one end of said skirt and a second toothed member on the other end of said skirt, said toothed members dimensioned to adjustably mesh with each other, and means for releasably locking said toothed members together in an adjusted position.

7. The invention as defined in claim 6 wherein said locking means comprises a resilient latch.

8. A cover assembly for a paint can having a tubular cylindrical sidewall and an open top comprising:

a lid dimensioned to overlie the open top of the paint can, said lid having a spout, paint stirring means rotatably secured to said lid, means for releasably securing said lid to the can, a closure pivotally mounted to said lid and pivotal between a closed position in which said closure covers said spout and an open position in which the closure is spaced from said spout, a cover detachably secured to said closure, said cover engaging and covering said spout when said closure is in said closed position.

9. The invention as defined in claim 8 wherein said cover includes a channel which slidably receives an end of said closure.

10. A cover assembly for a paint can having a tubular cylindrical sidewall and an open top comprising:

a lid dimensioned to overlie the open top of the paint can, said lid having a spout opening, paint stirring means rotatably secured to said lid, means for releasably securing said lid to the can, a closure pivotally mounted to said lid and pivotal between a closed position in which said closure covers said spout opening and an open position in which the closure is spaced from said spout opening, a spout cover, means for detachably securing said spout cover to said spout opening so that said spout cover covers said spout opening.

11. The invention as defined in claim 10 wherein said spout cover comprises a shield which overlies a portion of said lid.

12. The invention as defined in claim 10 wherein said lid comprises a threaded portion around said spout opening and wherein said detachable securing means comprises a threaded portion on said spout cover which threadably cooperates with said threaded portion on said lid.

13. The invention as defined in claim 10 wherein said spout cover includes means for changing the shape of said spout opening.

* * * * *